US006514628B1

(12) United States Patent
Ueno

(10) Patent No.: US 6,514,628 B1
(45) Date of Patent: Feb. 4, 2003

(54) REFLECTOR

(75) Inventor: Takashi Ueno, Kanagawa-ken (JP)

(73) Assignee: Furuya Metal Co., Ltd., Tokyo (JP)

( * ) Notice: Subject to any disclaimer, the term of this patent is extended or adjusted under 35 U.S.C. 154(b) by 5 days.

(21) Appl. No.: 09/723,203

(22) Filed: Nov. 27, 2000

(30) Foreign Application Priority Data

Nov. 26, 1999 (JP) ..... 11-336452

(51) Int. Cl.[7] ..... F21V 7/02

(52) U.S. Cl. ..... 428/624; 428/672; 428/913; 362/296

(58) Field of Search ..... 428/913, 624, 428/672; 362/296; 313/113

(56) References Cited

U.S. PATENT DOCUMENTS 5,140,457 A * 8/1992 Letter
5,882,760 A * 3/1999 Hatwar et al.
6,228,457 B1 * 5/2001 Ueno et al.

FOREIGN PATENT DOCUMENTS

JP Hei6-186407 7/1994

OTHER PUBLICATIONS

Japanese Patent Abstracts, Pub. No. 06–186407 'JP 6186407 A'. Matsushita Electric Works Ltd.

* cited by examiner

*Primary Examiner*—John J. Zimmerman
*Assistant Examiner*—Jason Savage
(74) *Attorney, Agent, or Firm*—Darby & Darby

(57) ABSTRACT

The object of the invention is to provide a reflector in which a reduction in high reflection factor of Ag is restricted, a stable wheatherability can be attained in a continuous manner even if it is exposed in a severe environment of high temperature and high humidity and further a high practical effect with the connecting characteristic being effectively enforced can be attained and also a high reliability is provided. The alloy reflective film made of AgPdCu alloy or AgPdTi alloy with Ag being applied as major component, with Pd being added in a range of 0.5 to 3.0 wt %, with either Cu or Ti, for example, in Al, Au, Pt, Cu, Ta, Cr, Ti, Ni, Co, Si as the third element being added in a range of 0.1 to 3.0 wt % is formed on the substrate in a predetermined film thickness (nm). As its pre-treatment, the organic ground film is applied on the substrate and the reflective film is formed on the film to enforce effectively the connecting characteristic.

6 Claims, 1 Drawing Sheet

REFLECTOR

BACKGROUND OF THE INVENTION

1. Field of the Invention

This invention relates to an improvement of a reflector used in vehicle-mounted lamps such as a head lamp or a fog lamp and the like or an outdoor illumination or indoor illumination equipment and the like and a plane mirror or curved mirror of an optical equipment including a laser equipment.

2. Description of the Related Art

Although this kind of reflector (normally called as a reflector) in the prior art has used a relative safe Al alloy or Al having a floating film formed therein under application of oxygen adsorption effect of alkaline earth metal by mainly adding alkaline earth metals such as Mg, Ca, Sr, Li and the like, application of Al capable of attaining a high intensity of illumination at a low electrical power cost or Ag having a higher reflection factor than that of Al alloy with its reflection factor being reduced than that of Al has been studied in recent years.

However, it is widely known that since a stability or re-generating characteristic of the film of the floating member is aimed for the case of Al, or the floating member itself aims at an improvement of an oxidization of Al, this material is not necessarily stable against the non-metallic component such as halogen elements such as chlorine, for example, added to the surrounding atmosphere, resulting in that actually in the case that it is employed in the reflector, either Al or Al alloy film is covered by the resin protection film of acrylic system to form the reflector.

In view of the foregoing, although Ag has a high evaluation in the case that the reflector of high reflection factor is formed as material having a high reflection factor in a range of visible rays as compared with that of Al, it shows that it has a quite high reacting characteristic such as xanthation, chloride reaction with a large amount of sulfur, chlorine or oxidization added to the surrounding atmosphere and so it is called that it is hard to apply it as a reflector film. That is, when Ag is exposed in the surrounding atmosphere for a long period of time, it becomes silver sulfade ($Ag_2S$) to cause its color to be changed black or it becomes silver chloride (AgCl) to cause its color to be changed white and to cause its optical characteristic to be deteriorated. Accordingly, if this material is exposed in the surrounding atmosphere for a long period of time, this shows a problem that an optical characteristic of Ag is deteriorated to cause its reflection factor to be reduced, so that it is said that this material is hardly applicable to illumination equipment or vehicle-mounted lamps and the like in recent years requiring a high intensity of illumination at a low electrical power cost.

In view of the foregoing, it has been proposed to provide, as a countermeasure to solve this problem and well-known in the art, a reflector having an improved wheatherability against sulfur and chlorine while keeping a high reflection factor by a method wherein an AgPd alloy reflective film having as its major component Ag added with Pd which is superior in its wheatherability with its amount being less than 30 wt % as well as a superior wheatherability such as chemical resistance which is hardly reacted with sulfur or chlorine, or an AgPt alloy reflective film having as its major component Ag added with Pt in its amount being less than 30 wt % is formed on a substrate acting as a supporting member (for example, refer to the Japanese Patent-Laid Open No. Hei 6-186407).

SUMMARY OF THE INVENTION

However, in such a prior art reflector as described above, although it is made apparent in reference to the result of an evaluation test that a high reflecting characteristic can be attained, it is not necessarily possible to say it sufficient that its wheatherability caused by discoloration or white muddy state under reaction with chlorine and sulfur and it still shows a problem not yet solved that its practical application is not sufficiently carried out.

That is, it is said that although Pd is a material showing a superior wheatherability which is hardly reacted with chlorine or sulfur as long as the material is not exposed in the atmosphere of high temperature and high humidity for a long period of time, this material may react with chlorine and sulfur if it is exposed in the atmosphere of high temperature and high humidity and there is a possibility that it may react with chlorine and sulfur to make chloride, xanthation and oxidization.

Accordingly, in the case that this material is applied in the vehicle-mounted lamps such as a head lamp or a fog lamp used in severe environment where its surrounding temperature is gradually increased as the time elapses, for example, and its humidity is also increased together with the temperature in a rainy day or the like, the material is exposed in the atmosphere of high temperature and high humidity for a long period of time, resulting in that there is a high possibility that its wheatherability is rapidly reduced and so it is a present situation that its more improved state is desired.

In addition, as described above, since the prior art reflector had a problem of uneasiness that it may be reacted with chlorine and sulfur to form chloride, xanthation and oxidization, resulting in that the reflector film was partially floated out of the substrate through this reaction to generate the film peeling-off phenomenon and had an inferior connecting characteristic (a close fitting force).

In addition, in the case that either Pd or Pt of 30 wt % was added in reference to the Japanese Patent Laid-Open No. Hei 6-186407, it was hard to say that the material was not at least appropriate material and could not be considered as an actual application as compared with the cost of Al or Al alloy due to the fact that market prices of both Pd and Pt were quite unstable and their costs were high.

This invention has been invented in reference to the aforesaid circumstances in the prior art, wherein it is an object of the present invention to provide a reflector in which a superior high reflection factor of Ag is restricted, a stable wheatherability can be attained in a continuous manner even if the reflector is exposed in an environment having severe high temperature and humidity, its connecting characteristic is effectively enforced, its practical effect is high and a high reliability can be attained.

In order to accomplish the subject matter, the present invention is constructed such that Pd acting as the second component is added to Ag acting as major component within a predetermined range, and an alloy reflective film having any one of these elements of Al, Au, Pt, Cu, Ta, Cr, Ti, Ni, Co, Si added as a third element within a predetermined range is formed on a substrate.

In addition, Pd acting as the aforesaid second element is added within a range of 0.5 to 3.0 wt % and any one of these third elements of Al, Au, Pt, Cu, Ta, Cr, Ti, Ni, Co, Si acting as a third element is added within a range of 0.1 to 3.0 wt %. In this case, a preferable amount of the second element is 0.7 to 2.3 wt % and more preferably 0.9 wt %. A preferable adding amount of the third element is 0.5 to 2.5 wt % and more preferably 1.0 wt %.

In the present invention, the aforesaid third element is Cu or Ti selected from any one of these Al, Au, Pt, Cu, Ta, Cr, Ti, Ni, Co, Si and an AgPdCu alloy reflector film or an AgPdTi alloy reflector film is formed on a substrate. In addition, a pre-treatment such as an organic ground film for improving a connecting characteristic with the reflector film is applied onto the substrate.

In the present invention, the aforesaid AgPdCu alloy or AgPdTi alloy is a sputtering target material or vapor depositing material and then either AgPdCu alloy reflector film or an AgPdTi alloy reflector film is formed on the substrate by the film forming process such as the sputtering process or the vapor deposition process.

Thus, in accordance with the technical means described above, it has been found that either AgPdCu alloy reflector film or an AgPdTi alloy reflector film, for example, in which Pd is added to Ag within a range of 0.1 to 3.0 wt % and further any one of these elements of Al, Au, Pt, Cu, Ta, Cr, Ti, Ni, Co, Si is added as a third element within a range of 0.1 to 3.0 wt % is formed on a substrate by the film forming process such as the sputtering process or the vapor deposition process, thereby occurrence of black spots or muddy white state through chloride formation, xathation and oxidization is prevented even in the atmosphere of high temperature and high humidity while keeping a high reflection factor and further the reflective film is prevented from being partially floated up from the substrate, resulting in that the alloy composed of three elements with this Ag being applied as the major component has its wheatherability substantially improved and a connecting characteristic with the substrate is effectively enforced.

DESCRIPTION OF THE PREFERRED EMBODIMENTS

Figure 1A:
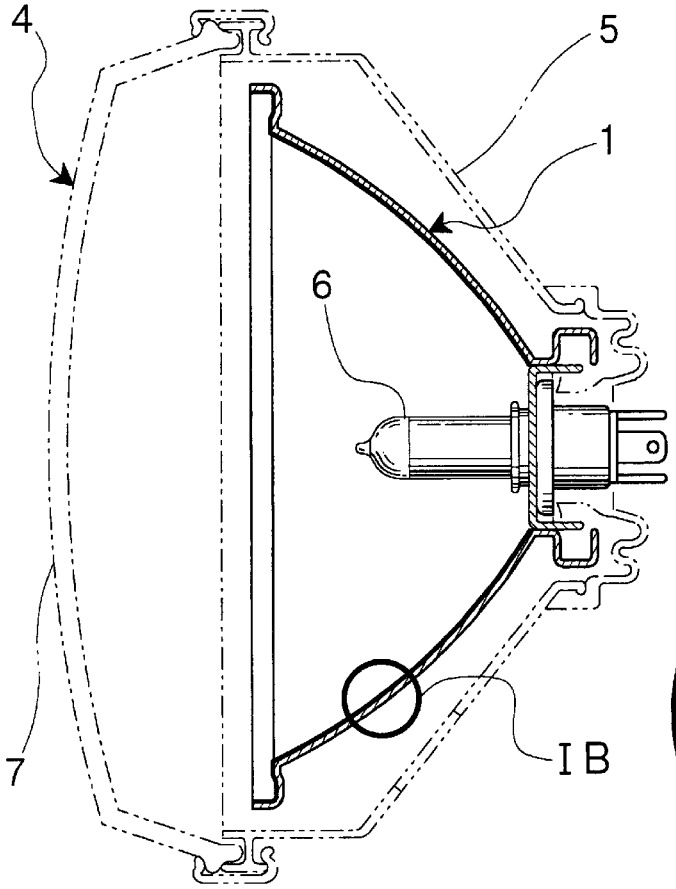
FIGS. 1A and 1B are sectional views for showing one example of the preferred embodiment of the reflector of the present invention in which the example of the vehicle-mounted lamp is applied.

Referring to the drawings, a practical example of the present invention will be described as follows.

Figure 1B:
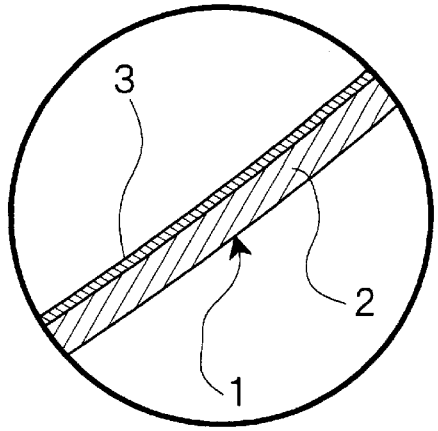

FIGS. 1A and 1B are a sectional view for showing one example of a preferred embodiment of a reflector 1 of the present invention, wherein this is used for a vehicle-mounted lamp 4 and in this preferred embodiment, three-element alloy reflector film in which Pd acting as a second element is added to Ag acting as major component and any one of these elements of Al, Au, Pt, Cu, Ta, Cr, Ti, Ni, Co, Si is added as a third element is formed onto a substrate 2 having a well-known sectional shape and becoming a supporting member stored and held in a lamp 5 to have a predetermined film thickness (nm) by a film forming process such as a sputtering process and a vapor deposition process. In this figure, 6 denotes a light source and 7 denotes a lens removably installed in the lamp 5.

In this case, it is well known in the art that Pd can be uniformly dispersed and mixed in a particle interface of Ag crystal by adding Pd to Ag with a predetermined amount of addition and melting it and a wheatherability of the entire Ag is improved. However, mere addition of Pd to Ag can not attain a sufficient wheatherability against chlorine and sulfur within the atmosphere of high temperature and high humidity. In addition, if Pd is added to such a degree as one in which a sufficient wheatherability can be attained even in the aforesaid atmosphere, a reflection factor of Ag is reduced. In other words, an optical characteristic of Ag is reduced.

In view of the foregoing, it becomes possible to restrict a reduction of a high reflection factor of Ag and to perform an effective improvement of the wheatherability by a method in which an adding amount of Pd is restricted within a range of 0.5 to 3.0 wt %, and an adding amount of any one of these elements of Al, Au, Pt, Cu, Ta, Cr, Ti, Ni, Co, Si acting as the third element is restricted within a range of 0.1 to 3.0 wt %.

Accordingly, in the present invention, it is an important matter to accomplish the present invention that Ag is applied as a major component, an adding amount of the second element Pd is restricted within a range of 0.5 to 3.0 wt % and an adding amount of any one of Al, Au, Pt, Cu, Ta, Cr, Ti, Ni, Co, Si of the third element is restricted within a range of 0.1 to 3.0 wt %.

A reason for it consists in the fact that if the adding amount of the second element is less than 0.5 wt %, a color of it is changed into yellow under an environment of high temperature and high humidity and its reflection factor is apt to be decreased or a stability against chlorine is not necessarily high, resulting in that studying of the aging variation under the case in which it is left in the surrounding atmosphere as a reflector for a long period of time shows that its stability is inferior and in turn if the value exceeds 3.0 wt %, a reflection factor of Ag is remarkably reduced to cause its practical application to become impossible.

In addition, another reason consists in the fact that if an adding amount of the third element is less than 0.1 wt %, a substantial stability of the material Pd against a hydrogen dissolving capability becomes inferior, resulting in that in the case that the material is left under the high temperature and high humidity, for example, an occurrence of black protrusions generated in the two-element alloy having only Pd added to Ag is confirmed and its wheatherability as the material becomes unstable and in turn if the value exceeds 3.0 wt %, it is highly influenced by the added substance, resulting in that in the case of Al, Cu, Si, these elements may become easily connected with oxygen to damage its stability of Ag against oxygen and in turn in the case of Pt, Ta, Cr, its internal stress when it is formed into a film may become remarkably high, a close fitness against the substrate of synthetic resin is remarkably reduced and further as to Au, Ti, Ni, Co, their reflection factors are substantially decreased, resulting in that the effects attained by the present invention are damaged.

In this way, the characteristic of Ag having the most superior high reflection factor in the metallic elements can be maintained by adding the second element within a range of 0.5 to 3.0 wt % and further by adding and melting the third element within a range of 0.1 to 3.0 wt % and then an Ag alloy having its wheatherability effectively improved can be attained. In this case, a preferable adding amount of the second element is 0.7 to 2.3 wt % and most preferably 0.9 wt %. In addition, a preferable amount of the third element is 0.5 to 2.5 wt % and most preferable amount is 1.0 wt %. The Ag alloy attained in this way is applied as either the sputtering target material or the vapor deposition material used in film formation of the aforesaid alloy reflective film 3.

EXAMPLE

The alloy reflective film 3 having a predetermined film thickness (nm) comprised of AgPdCu alloy or AgPdTi alloy with Pd of the second element added within a range of 0.5 to 3.0 wt % against pure Ag and either Cu or Ti added within a range of 0.1 to 3.0 wt % is formed into a film on the surface of the substrate 2 acting as the supporting member by a sputtering process or vapor deposition process so as to attain the reflector 1 applied to the vehicle-mounted lamp 4 (refer to FIGS. 1A and 1B).

A reason why either Cu or Ti is selected from each of these metallic elements of Al, Au, Pt, Cu, Ta, Cr, Ti, Ni, Co, Si acting as the third element consists in the fact that either Cu or Ti is the most effective metallic element as the third element for effectively restricting the reduction in the high reflection factor of Ag and effectively improving the wheatherability where a high reliability can be attained for a long period of time under the severe environment of high temperature of 600° C. and humidity of 100%, for example, as compared with the case in which only Pd is added until the wheatherability of Ag against chlorine or sulfur contained in the surrounding atmosphere.

In this example, the substrate 2 is mainly formed by metal and synthetic resin and the like.

Then, either the sputtering target material or the vapor deposition material will be described.

In the case that either Cu or Ti is added to Ag as the sputtering target material or the vapor deposition material, it is hard to make a complete solid dissolving of either Cu or Ti to Ag. Accordingly, since a composition of either Cu or Ti is partially varied, a composition of either Cu or Ti is varied also in either the AgCu alloy or AgTi alloy formed under application of the sputtering target and so a stable optical characteristic can not be attained.

In view of this fact, if either Cu or Ti is added as the third element to the AgPd alloy, it has been found that either Cu or Ti may relatively and easily be solid melted. This has been confirmed by the fact that Pd is solid melted with each of the atoms of Ag, Cu, Ti. Accordingly, it may be considered that Pd may act as the solid dissolving assistant, generate a primary solid dissolving reaction with each of the elements against Ag and Cu or Ti hardly solid dissolved, generate the secondary solid dissolving reaction with the remaining one element to form a coupled state, thereby a complete solid dissolved member can be formed in three elements.

A result of experiment of evaluation measurement against a reflection factor and wheatherability for the reflector member 1 of the present invention having either the AgPdCu alloy or AgPdTi alloy reflective film 3 attained in reference to the details of the present example formed as a film on the substrate 2 (hereinafter called as the product of the present invention) and the prior art reflector having either AgPd alloy reflective film formed (hereinafter called as the prior art product) will be described as follows.

At first, the evaluation measurement as to the reflection factor will be described, wherein a sample formed by making the alloy reflective film having each of the compositions by sputtering process or the vapor deposition process on the glass substrate having a smooth surface was applied. A film thickness of each of them is 12 nm and a wavelength region applied is 400 to 800 nm.

In this case, a reason why these wavelength regions were selected consists in the fact that a wavelength radiated from the light source 6 applied to the vehicle-mounted lamp 4 of the illumination equipment or vehicle-mounted lamps such as a head lamp or a fog lamp, in particular, is generally set to a range of 400 to 800 nm. In Table 1 is indicated a result of test.

TABLE 1

| Composition of material (wt %) | Wavelength 500 nm Reflection factor (%) | Wavelength 800 nm Reflection factor (%) |
|---|---|---|
| Al | 87.2 | 84.5 |
| Al96.0Mg4.0 | 83.1 | 82.3 |
| Al covered by acrylic resin | 79.4 | 76.6 |
| Ag | 98.2 | 98.8 |
| Ag98.0Pd20.0 | 91.3 | 94.5 |
| Ag97.0Pd30.0 | 86.9 | 92.1 |
| Ag99.8Pd0.1Cu0.1 | 98.0 | 98.6 |
| Ag99.4Pd0.5Cu0.1 | 98.0 | 98.4 |
| Ag98.1Pd0.9Cu1.0 | 97.8 | 98.0 |
| Ag98.9Pd1.0Cu0.1 | 94.4 | 97.6 |
| Ag97.9Pd2.0Cu0.1 | 91.4 | 94.6 |
| Ag96.9Pd3.0Cu0.1 | 87.5 | 93.4 |
| Ag96.5Pd3.0Cu0.5 | 87.3 | 92.7 |
| Ag94.0Pd3.0Cu3.0 | 84.7 | 91.1 |
| Ag99.8Pd0.1Ti0.1 | 98.0 | 98.6 |
| Ag99.4Pd0.5Ti0.1 | 98.0 | 98.4 |
| Ag98.1Pd0.9Ti1.0 | 97.6 | 97.9 |
| Ag98.9Pd1.0Ti0.1 | 94.4 | 97.6 |
| Ag97.9Pd2.0Ti0.1 | 91.4 | 94.6 |
| Ag96.9Pd3.0Ti0.1 | 87.5 | 93.4 |
| Ag96.5Pd3.0Ti0.5 | 87.0 | 92.5 |
| Ag94.0Pd3.0Ti3.0 | 84.5 | 90.7 |

As apparent from Table 1, it has been found that the product of the present invention has similarly a high reflection factor of the prior art product.

That is, even in the product of the present invention in which the reflective film 3 composed of either AgPdCu alloy or AgPdTi alloy having Ag added as a major component with Pd added within a range of 0.5 to 3.0 wt % and either Cu or Ti acting as third element added in a range of 0.1 to 3.0 wt % is formed on the substrate 3 as the film, it is apparent that a superior high reflection factor of pure Ag is maintained and the reflector member 1 having a high intensity of illumination can be attained at a low electrical power cost.

Then, an evaluation measurement about the wheatherability in view of the chemical resistance will be described, wherein the sample made by forming the alloy reflective film of each of the components on the quartz glass substrate by the sputtering process or the vapor deposition process was used. A film thickness of each of them is 12 nm. At this evaluation test, solution liquid of 1% $H_2SO_4$, 3% NaCl and 1% KOH was dripped onto each of the samples and after elapsing of 10 minutes, or after elapsing of 30 minutes, each of them was observed with naked eyes. The test results are indicated in Table 2.

TABLE 2

| Composition of material (wt %) | 1% $H_2SO_4$ | 3% NaCl | 1% KOH |
|---|---|---|---|
| Al | Complete reaction | Complete reaction | Complete reaction |
| Al96.0Mg4.0 | Complete reaction | Complete reaction | Complete reaction |
| Al covered by acrylic resin | Partial reaction | Partial reaction | Partial reaction |
| Ag80Pd20 | Large black spot | Large black spot | Large black spot |
| Ag70Pd30 | Middle black spot | Middle black spot | Middle black spot |
| Ag99.8Pd0.1Cu0.1 | No change | No change | No change |
| Ag99.4Pd0.5Cu0.1 | No change | No change | No change |
| Ag98.1Pd0.9Cu1.0 | No change | No change | No change |
| Ag98.9Pd1.0Cu0.1 | No change | No change | No change |

TABLE 2-continued

| Composition of material (wt %) | 1% $H_2SO_4$ | 3% NaCl | 1% KOH |
|---|---|---|---|
| Ag97.9Pd2.0Cu0.1 | No change | No change | No change |
| Ag96.9Pd3.0Cu0.1 | No change | No change | No change |
| Ag96.5Pd3.0Cu0.5 | No change | No change | No change |
| Ag94.0Pd3.0Cu3.0 | No change | No change | No change |
| Ag99.8Pd0.1Ti0.1 | No change | No change | No change |
| Ag99.4Pd0.5Ti0.1 | No change | No change | No change |
| Ag98.1Pd0.9Ti1.0 | No change | No change | No change |
| Ag98.9Pd1.0Ti0.1 | No change | No change | No change |
| Ag97.9Pd2.0Ti0.1 | No change | No change | No change |
| Ag96.9Pd3.0Ti0.1 | No change | No change | No change |
| Ag96.5Pd3.0Ti0.5 | No change | No change | No change |
| Ag94.0Pd3.0Ti3.0 | No change | No change | No change |

In the case of the prior art product, a loss and white muddy state of the AgPd alloy reflective film were observed not by the added amount of Pd but after elapsing of 10 minutes upon dripping of chemical liquid and then it was confirmed that the product was reacted with each of the chemical liquids.

To the contrary, the product of the present invention did not show any discoloration at all even after 10 minutes and 30 minutes elapsed upon dripping of the chemical liquid. With such an arrangement as above, it is apparent that the wheatherability has been substantially improved by either Cu or Ti added as the third element.

Further, the evaluation measurement over the wheatherability performed under a severe environment of high temperature and high humidity as the evaluation test for a reliability of long period of time will be described as follows. In this case, the sample in which the alloy reflective film of each of the components is formed on the aforesaid quartz glass substrate by sputtering process or vapor deposition process was applied and exposed for 24 hours in the air atmosphere of high temperature of 600° C. and high humidity of 100%, thereafter the sample was observed with naked eyes. The test result is indicated in Table 3.

TABLE 3

| | Result of test of high temperature and high humidity | |
|---|---|---|
| Composition of material (wt %) | Chemical characteristic change (reflection factor is reduced) | White muddy state and peeling from the substrate |
| Ag80Pd20 | Large black spot is generated. | Peeling from the substrate is generated. |
| Ag70Pd30 | Middle black spot is generated. | Peeling from the substrate is generated. |
| Ag99.8Pd0.1Cu0.1 | No change | Less white muddy state |
| Ag99.4Pd0.5Cu0.1 | No change | No change |
| Ag98.1Pd0.9Cu1.0 | No change | No change |
| Ag98.9Pdl.0Cu0.1 | No change | No change |
| Ag97.9Pd2.0Cu0.1 | No change | No change |
| Ag96.9Pd3.0Cu0.1 | No change | No change |
| Ag96.5Pd3.0Cu0.5 | No change | No change |
| Ag94.0Pd3.0Cu3.0 | No change | No change |
| Ag99.4Pd0.1Ti0.1 | No change | No change |
| Ag99.4Pd0.5Ti0.1 | No change | No change |
| Ag98.1Pd0.9Ti1.0 | No change | No change |
| Ag98.9Pd1.0Ti0.1 | No change | No change |
| Ag97.9Pd2.0Ti0.1 | No change | No change |
| Ag96.9Pd3.0Ti0.1 | No change | No change |
| Ag96.5Pd3.0Ti0.5 | No change | No change |
| Ag94.0Pd3.0Ti3.0 | No change | No change |

In the prior art product, occurrence of black spots was confirmed. The occurrence of the black spots showed that as the result of observation with a microscope, the product was reacted with each of the chemicals to produce chloride product, xathation and oxidization. In addition, it was confirmed that there was a film peeling in which the AgPd alloy reflective film was partially floated from the substrate. This fact can be considered to be caused by a weak close fitting power between the AgPd alloy reflective film and the substrate and an oxidization phenomenon in which the reflective film is partially corroded to form a white muddy state.

To the contrary, the product of the present invention did not show any aging even under such a severe environment of high temperature and high humidity as above. In addition to these tests, the product was tested further while it is being left in the severe environment of oxygen for 24 hours with temperature of 750° C. and with humidity of 100%, resulting in that no change was observed even under such a severe condition and further the wheatherability was remarkably improved. In addition, the film peeling from the substrate was not observed at all.

As described above, it was found that either Cu or Ti was added as the third element to cause the wheatherability to be remarkably improved and a coupling feature with the substrate was effectively enforced.

As apparent from the test result as above, either the AgPdCu alloy reflective film or AgPdTi alloy reflective film having Ag as the major component, Pd in a range of 0.1 to 3.0 wt % and having either Cu or Ti as the third element within a range of 0.1 to 3.0 wt % is used as a reflective film 3 formed on the substrate 2, thereby a stable wheatherability not reacting with chlorine and sulfur is confirmed while the high reflection factor is being maintained and even under a severe environment of high temperature of 600° C. and high humidity of 100%, thereby a high reliability can be attained for a long period of time even if it is applied to the vehicle-mounted lamp 4 used under a severe environment.

Figure 2:
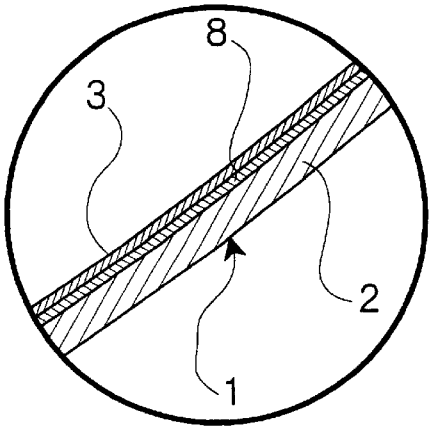
FIG. 2 is a partial enlarged view for showing another preferred embodiment of the reflector.

FIG. 2 shows another preferred embodiment of the reflector 1 of the present invention in the case that it is used as the vehicle-mounted lamp 4, wherein in such an embodiment as above, this shows one example of the preferred embodiment of the reflector 1 in which in order to enforce the connecting characteristic between the substrate 2 acting as the supporting member and the reflector film 3, the organic ground film 8 is formed on the substrate 2 as the pre-treatment and the reflective film 3 made of AgPdCu alloy or AgPdTi alloy with Ag being applied as major component having Pd of 0.5 to 3.0 wt % and either Cu or Ti of 0.1 to 3.0 wt % in the detailed description of the above embodiment added thereto is formed into a film.

In such an preferred embodiment as above, except that the constitution in which the organic ground film 8 is formed on the substrate 2 and the reflective film 3 made of either AgPdCu alloy or AgPdTi alloy is formed on the ground film, the constitution, i.e. the AgPdCu alloy or AgPdTi alloy in which Ag is applied as the major component, Pd is added in a range of 0.5 to 3.0 wt %, and further as the third element, any one of Al, Au, Pt, Cu, Ta, Cr, Ti, Ni, Co, Si is added, for example, either Cu or Ti being added within a range of 0.1 to 3.0 wt % will be eliminated for its description because they are basically the same as that of the detailed embodiment.

In the aforesaid detailed description of the preferred embodiment, the reflector for the vehicle-mounted lamp has been described, although it is apparent that the present invention could be applied to the reflector used in an outdoor or indoor illumination equipment, a flat mirror or curved mirror of an optical equipment including laser device and various kinds of reflectors widely used in the variety of fields in application.

Since the reflector of the present invention has been constructed as described above, it has the following actions and effects. The reflector film is formed on the substrate by a sputtering process or the vapor deposition process under application of three-element alloy in which Pd of the second element is added in a range of 0.5 to 3.0 wt % and having Ag as major component with any one of these elements of Al, Au, Pt, Cu, Ta, Cr, Ti, Ni, Co, Si of the third element being added in a range of 0.1 to 3.0 wt %, a wheatherability not having any formation of xathation, chloride and oxidization is improved even if the product is placed in a severe environment of high temperature of 600° C. and high humidity of 100% and exposed for a long period of time while keeping a high reflection factor of the prior art product, and the connecting characteristic with the substrate is enforced more effectively and a high reliability can be attained.

Accordingly, in accordance with the present invention, even if the reflector is applied as an outdoor or indoor illumination equipment or vehicle-mounted lamp where a high intensity of illumination under a low electrical power cost is desired, in particular, a vehicle-mounted lamp used in a severe environment, a high reliability can be attained for a long period of time and then it is possible to provide the reflector having a high practical effect.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A reflector comprising a substrate having an alloy reflector film thereon, the alloy reflector film comprising Ag as a major component, Pd, and a third element selected from the group consisting of Ta, Ni, Co, and Si.

2. The reflector of claim 1 wherein the alloy reflector film comprises 0.5 to 3.0 wt % of Pd and 0.1 to 3.0 wt % of the third element, based on 100% total weight of the alloy reflector film.

3. A lamp comprising a light source and the reflector of claim 2.

4. A lamp comprising a light source and the reflector of claim 1.

5. A lamp comprising (a) a light source; and (b) a substrate having an alloy reflector film thereon, the alloy reflector film comprising Ag as a major component, Pd, and a third element selected from the group consisting of Al, Au, Pt, Cu, Ta, Cr, Ti, Ni, Co, and Si.

6. The lamp of claim 5, wherein the alloy reflector film comprises 0.5 to 3.0 wt % of Pd and 0.1 to 3.0 wt % of the third element, based on 100% total weight of the alloy reflector film.

* * * * *